US005562432A

United States Patent [19]

Semba et al.

[11] Patent Number: 5,562,432

[45] Date of Patent: Oct. 8, 1996

[54] VARIABLE DISPLACEMENT PUMP HAVING THROTTLED CONTROL PASSAGES

[75] Inventors: Fusao Semba; Kenya Yasui, both of Saitama, Japan

[73] Assignee: Jidosha Kiki Co., Ltd., Tokyo, Japan

[21] Appl. No.: 580,187

[22] Filed: Dec. 28, 1995

[30] Foreign Application Priority Data

Jan. 26, 1995 [JP] Japan ..... 7-010430

[51] Int. Cl.[6] ..... F04C 15/04

[52] U.S. Cl. ..... 418/26; 418/30; 417/220

[58] Field of Search ..... 417/220; 418/24, 418/25, 26, 27, 30

[56] References Cited

U.S. PATENT DOCUMENTS 3,784,326 1/1974 Lagana et al. ..... 418/26

FOREIGN PATENT DOCUMENTS 53-130505 11/1978 Japan .
56-143383 11/1981 Japan .
58-93978 6/1983 Japan .
63-14078 4/1988 Japan .
6167281 6/1994 Japan ..... 418/27
6241175 8/1994 Japan ..... 418/30
6241176 8/1994 Japan ..... 418/30
2232208 12/1990 United Kingdom ..... 418/30

*Primary Examiner*—Timothy S. Thorpe
*Assistant Examiner*—Roland G. McAndrews, Jr.
*Attorney, Agent, or Firm*—Sughrue, Mion, Zinn, Macpeak & Seas

[57] ABSTRACT

To restrain the swinging of a movable displaceable cam ring and a spool of a control valve and to suppress pulsation on the discharge side of a variable displacement pump. In the variable displacement pump, a variable metering orifice (40) is provided midway in discharge-side passages (24, 29, 43, 44, 45) extending from a pump chamber. A spool-type control valve (30) is operated with the fluid pressure on the upstream and downstream sides of the orifice to control the fluid pressure supplied to fluid-pressure chambers around the cam ring in accordance with the flow rate of the fluid discharged from the pump chamber. A single or multistage throttle portion including throttles (50, 51, 52) is provided in at least one of fluid passages (46, 47) for communicating the upstream side of the orifice to one chamber of the valve, and fluid passages (35, 19*b*) for communicating the one chamber to the first fluid-pressure chamber as the valve operates.

10 Claims, 6 Drawing Sheets

FIG. 5(b) PRIOR ART

VARIABLE DISPLACEMENT PUMP HAVING THROTTLED CONTROL PASSAGES

BACKGROUND OF THE INVENTION

The present invention relates to a variable displacement vane pump for use in various types of equipment using pressure fluid such as a power steering apparatus for alleviating the force of operating the steering wheel of an automobile.

Conventionally, volume-type vane pumps which are directly driven by an automobile engine to rotate have generally been employed as pumps for power steering apparatus. Since a discharge flow rate increases or decreases in proportion to the number of revolutions of the engine, however, such volume-type pumps have characteristics mutually contradictory to those of the power steering 0apparatus in that a large steering-assisting force is required during a standstill or low-speed running, whereas a small steering-assisting force is required during high-speed running. Therefore, the volume of such a pump has to be large enough to secure a discharge flow rate which makes it possible to obtain a required steering-assisting force even during low-speed running when the number of revolutions is small. Moreover, a flow control valve becomes indispensable to controlling the discharge flow rate so as to keep it at a fixed level or lower during high-speed running when the number of revolutions is large. For this reason, the number of component parts for use in constituting the pump tends to increase and not only the structure of each pump but also that of passages therein become complex, thus inevitably making the overall apparatus large in size and costly.

In order to obviate drawbacks characteristic of volume-type pumps, there have been proposed various variable displacement vane pumps capable of reducing a discharge flow rate per turn (cc/rev) in proportion to an increase in the number of revolutions as in Japanese Patent Laid-Open Publications Nos. SHO-53-130505/1978, SHO-56-143383/1981, SHO-58-93978/1983, and Japanese Utility Model Publication No. SHO-63-14078/1988. These variable displacement pumps each require no flow control valves as those used in the volume type, prevent a wasteful increase in driving power and excel in the energy efficiency. Moreover, such variable displacement pumps are capable of preventing the oil temperature from rising as there is no return flow to the tank side, and solving problems arising from leakage in the pump interior and a decline in the volume efficiency.

The variable displacement pumps disclosed in Japanese Patent Laid-Open No. SHO-56-143383 are arranged as follows: A cam ring is provided movably in a pump casing; a pair of fluid-pressure chambers serving as control chambers are formed in a gap between the cam ring and the pump casing; and the pressure on the upstream and downstream sides of an orifice provided midway in a discharge passage is made to act directly on the cam ring so as to move the cam ring against the urging force of a spring to change the volume of the pump chamber, whereby discharge flow-rate control is properly effected.

Referring now to FIG. 6, there is shown an example of the variable displacement vane pump described above. In FIG. 6, reference numeral 1 designates a pump body; 1*a*, an adaptor ring; and 2, a cam ring which is provided within an elliptical space 1*b* formed in the adaptor ring 1*a* in a swinging, displaceable manner via a pivotally supporting portion 2*a*, and to which an urging force is imparted by a press means in the direction indicated by a dropout arrow in the drawing. Further, reference numeral 3 designates a rotor which is accommodated in the cam ring 2 while being situated to one side with reference to the center in such a manner as to form a pump chamber 4 on the other side, and which allows vanes 3*a* to move back and forth, the vanes 3*a* being held in a manner capable of radially advancing or retracting when the rotor 3 is driven by an external driving source to rotate.

Incidentally, reference numeral 3*b* in FIG. 6 designates the drive shaft of the rotor 3, which is driven to rotate in the direction of the arrow.

Further, reference numerals 5, 6 designate a pair of fluid-pressure chambers which become high- and low-pressure sides each formed on both sides of the outer periphery of the cam ring 2 in the elliptical space 1*b* of the adaptor ring 1a of the body 1, and there are passages 5*a*, 6*a* opened to the chambers 5, 6 and used for introducing control pressure for swinging and displacing the cam ring 2, for example, fluid pressure on the upstream and downstream sides of a variable orifice provided in a pump discharge-side passage. When the fluid pressure on the upstream and downstream sides of the variable orifice in the pump discharge-side passage is thus introduced through the passages 5*a*, 6*a*, the cam ring 2 is swung and displaced in a desired direction to render variable the volume of the pump chamber 4, so that a discharge-side flow rate is variably controlled in proportion to the flow rate on the discharge side of the pump. In other words, the discharge-side flow rate is so controlled as to decrease the discharge-side flow rate as the number of revolutions of the pump increases.

Reference numeral 7 designates a pump suction-side opening which is open in face-to-face relation to a pump suction-side region 4A in the pump chamber 5; and 8, a pump discharge-side opening which is open in face-to-face relation to a pump discharge-side region 4B. These openings 7, 8 are formed in either pressure or side plate (neither is shown) and both of them are fixed wall portions for holding the rotor 4 and the cam ring 2 constituting a pump component element by clamping the same from both sides thereof.

In this case, an urging force is imparted to the cam ring 2 from the side of the fluid-pressure chamber 6 as shown by F of FIG. 6, so that the volume of the pump chamber 5 is normally maintained at a maximum level. In addition, reference numeral 2*b* in FIG. 6 designates a seal member provided on the outer periphery of the cam ring 2 so as to define the fluid-pressure chambers 5, 6 on both left- and right-hand sides in association with the pivotally supporting portion 2*a* provided on the outer periphery thereof.

Further, reference numeral 8*a* designates a goatee-shaped notch formed in such a manner as to continue from a terminating portion, in the rotational direction of the pump, of the pump suction-side opening 8. When leading ends of the vanes 3*a* are brought into sliding contact with the inner periphery of the cam ring 2 as the rotor 3 rotates to make them perform pumping action, the notch 8*a* functions as what allows the fluid pressure to escape gradually from the-high-pressure side to the low-pressure side between the space held by vanes approaching the end portion of each of the openings 7, 8 and the space between vanes adjacent thereto. The notch 8*a* is effective in preventing the occurrence of surge pressure and the problem of pulsation arising therefrom.

With the variable displacement pump thus constructed as described above, a relief valve for relieving excessive fluid pressure is additionally installed on a part of the pump discharge side.

In the conventional variable displacement vane pump described above, the pump chamber (the chamber partitioned by the vanes 3*a*, 3*a*) 4 has the pump discharge pressure and the pump suction pressure alternately in a pump cartridge (pump acting portion) with the pump component elements including the rotor 3, the cam ring 2 and the like when it is positioned in the region ranging from the terminating point of the suction-side opening 4A up to the starting point of the discharge-side opening 4B in the pump chamber and when it is positioned in the intermediate region (the portion indicated with symbols 9A, 9B of FIG. 6) ranging from the terminating point of the discharge-side opening 4B up to the starting point of the suction-side opening 4A.

This is due to the fact that when the preceding vane 3*a* in the direction in which the rotor 3 rotates reaches the opening 4B or 4A on the leading end side in the rotational direction, the vane 3*a* has pressure equal to the port pressure on the pump discharge or suction side in the opening 4A or 4B and when the following vane 3*a* stays at the opening 4A or 4B on the rear end side in the rotational direction, it has pressure equal to the port pressure because of the opening that follows.

An odd number of vanes 3*a* are employed in a variable displacement vane pump of this type in particular, the vanes 3*a* are unevenly arranged in the direction in which the rotor 3 rotates and consequently, the space formed between the vanes 3*a*, 3*a* passing through the intermediate region 9A and what is formed between those which pass through the intermediate region 9B facing the former with the rotary shaft 3*b* of the rotor 3 are set asymmetrical, so that the pressure balance tends to become disturbed.

As thrust due to the mutual difference between the pump chambers in the opposing intermediate regions 9A, 9B originating from such unbalanced pressure as well as pressure fluctuation acts on the inner face of the cam ring 2, the cam ring 2 is caused to swing thereby, which results in producing phenomena of flow-rate fluctuation and oil-pressure pulsation on the discharge side of the pump, thus making a noise problem. The pulsating phenomenon appears as shown in a characteristic graph of FIG. 5(*b*).

For the reason stated above, it has been proposed to provide a metering orifice midway in the pump discharge-side passage of the aforesaid variable displacement vane pump. The fluid pressure on the upstream and downstream sides of the orifice is then used for switching the operation of spool-type control valve so to supply the fluid pressure on the upstream and downstream sides of the orifice and to apply the suction side of the pump selectively to the chambers 5, 6 on both sides of the outer periphery of the cam ring 2, whereby the swinging phenomenon of the cam ring 2 is suppressed. Nevertheless, the arrangement thus proposed still remains unsatisfactory and some countermeasures have been desired to be taken.

Particularly when utilizing equipment to be supplied with fluid pressure from the variable displacement pump operates, the fluid pressure in the main supply passages rises and thereby the pressure difference between the upstream and downstream sides of the metering orifice installed in the passage or the pump discharge-side passage increases. It is therefore necessitated to solve a problem arising from the fluctuation of the pump discharge-side pressure which becomes increased and conspicuous.

When the utilizing equipment is a power steering wheel, for example, the power steering wheel may become difficult or easy to manipulate as a high and a low flow rate are applied to the power steering wheel side. Instability like this needs obviating.

In the conventional variable displacement pump-above, there is also a problem arising from the swinging phenomenon cause to a spool in the control valve for controlling the fluid pressure supplied to the high- and low-pressure sides of the fluid-pressure chamber so as to move and displace the cam ring.

In other words, the pump discharge-side fluid on the upstream side of the metering orifice is introduced into the one chamber of the spool in the control valve, whereas the pump discharge-side fluid on the downstream side of the metering orifice is introduced into the other chamber having the spring. Moreover, the pressure difference between the front and rear of the orifice increases as the flow rate of the discharge-side fluid rises, and the desired fluid pressure is introduced to the high-pressure side of the fluid-pressure chamber when the spool of the valve moves to the other chamber side to cause the cam ring to be moved and displaced, so that the flow rate of the discharge-side fluid is reduced.

When, however, the load on the utilizing equipment side causes the fluid pressure on the discharge side of the pump in such a control valve, the spool within the valve is also caused to swing and the so-called swinging phenomenon occurs. This point is also desired to be taken into consideration.

In the conventional variable displacement pump, a dampening orifice is formed in the fluid passage for use in introducing the fluid pressure on the downstream side of the metering orifice into the other chamber having the spring of the control valve to stabilize the movement of the spool in the valve. However, only the provision of the damping orifice has little throttling effect and allows the spool in the valve to readily swing because the passage flow rate of the fluid is low, which results in not only rendering unstable the fluid pressure in each fluid-pressure chamber under the control of the valve but also causing the cam ring to swing. Consequently, it is desired to clear away those problems mentioned above as they are impossible to suppress.

SUMMARY OF THE INVENTION

An object of the present invention made in view of the foregoing circumstances is to obtain a variable displacement pump capable of suppressing a swinging phenomenon in a control valve and a cam ring, reducing sharp flow-rate fluctuations, pulsation and so forth on the discharge side of a pump, and eliminating a noise problem.

In order to comply the demand above, a variable displacement pump comprises: a cam ring fitted to the outer periphery of a rotor which is rotatable within a pump body so as to form a pump chamber, the cam ring being installed so that it is movable and displaceable within the body; a first and a second fluid-pressure chamber formed between the outer periphery of the cam ring and the body so as to move and displace the cam ring by selectively introducing fluid pressure between the front and rear of a metering orifice installed midway from the pump chamber up to a discharge-side passage or the fluid pressure on the suction side of the pump; and a spool-type control valve for controlling the fluid pressure supplied to each fluid-pressure chamber in proportion to the flow rate of the pressure fluid discharged from the pump chamber, the control valve being operated by the fluid pressure between the front and rear of the metering orifice, wherein the upstream side of the metering orifice in the discharge-side passage from the pump chamber is coupled via a fluid passage to one chamber of the control valve; the downstream side of the metering orifice is coupled via the fluid passage to the other chamber of the control valve; the suction side of the pump is coupled to the axially-directed central part of the control valve; a fluid passage is provided so as to selectively couple the discharge and suction sides of the pump coupled to the one chamber of the control valve to the first fluid-pressure chamber in response to the movement of the spool; and a throttle portion having a single stage or a multistage throttle is provided in at least either fluid passage extending from the discharge side of the pump up to the one chamber of the control valve or what extends from the control valve up to the first fluid-pressure chamber.

The metering orifice for operating the control valve for controlling the fluid pressure supplied to the first and second fluid-pressure chambers on the outer peripheral side of the cam ring according to the present invention is formed as a variable metering orifice with a hole portion bored in the side wall portion arranged on the side portion of the cam ring, and the side portion of the cam ring for controlling the opening and closing of the open end of the hole portion.

According to the present invention, the cam ring is urged so that the volume of the pump chamber formed on one side of the pump body with respect to the rotor is maximized when the pump is started and the control valve exerts control so as to couple the first fluid-pressure chamber to the suction side of the pump and to couple the second fluid-pressure chamber to the downstream side of the metering orifice on the discharge side of the pump.

When the number of revolutions of the pump gradually increases, the operation of the control valve is changed over on the discharge side of the pump by the pressure difference between the fluid pressure on the upstream side of the orifice and the fluid pressure on the downstream side thereof, and the fluid pressure on the upstream and downstream sides of the variable metering orifice on the discharge side of the pump is introduced into the first and second fluid-pressure chambers on both sides of the cam ring, whereby the cam ring is caused to move and displace in the direction in which the volume of the pump chamber is reduced.

The provision of the fluid passage for coupling the discharge side of the pump to the one chamber of the control valve, and the throttle portion in the fluid passage extending from the control valve up to the first fluid-pressure chamber then allows the fluid pressure on the discharge side of the pump to be sent in such a condition that the fluid pressure fluctuations have been suppressed, so that the spool and the control valve and the cam ring are restrained from swinging.

BRIEF DESCRIPTION OF THE DRAWINGS

FIG. 5(*b*) is a characteristic diagram showing the relationship between the number of revolutions of the pump and a discharge flow-rate in a conventional comparative example.

DETAILED DESCRIPTION OF THE PREFERRED EMBODIMENT

Figure 1:
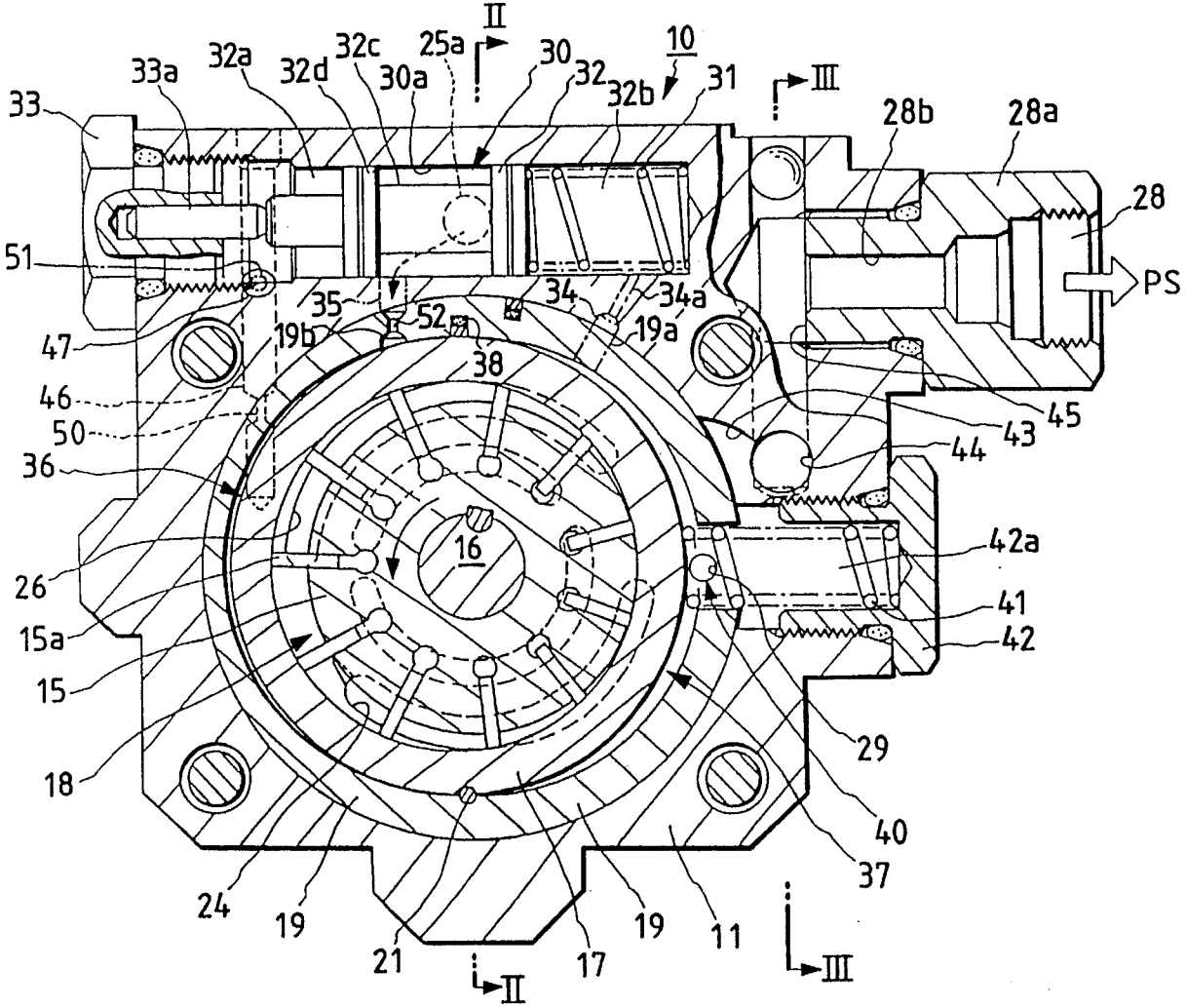
FIG. 1 is a schematic transverse sectional view of the structure of the principal part of a variable displacement pump according to an embodiment of the present invention.
Figure 2:
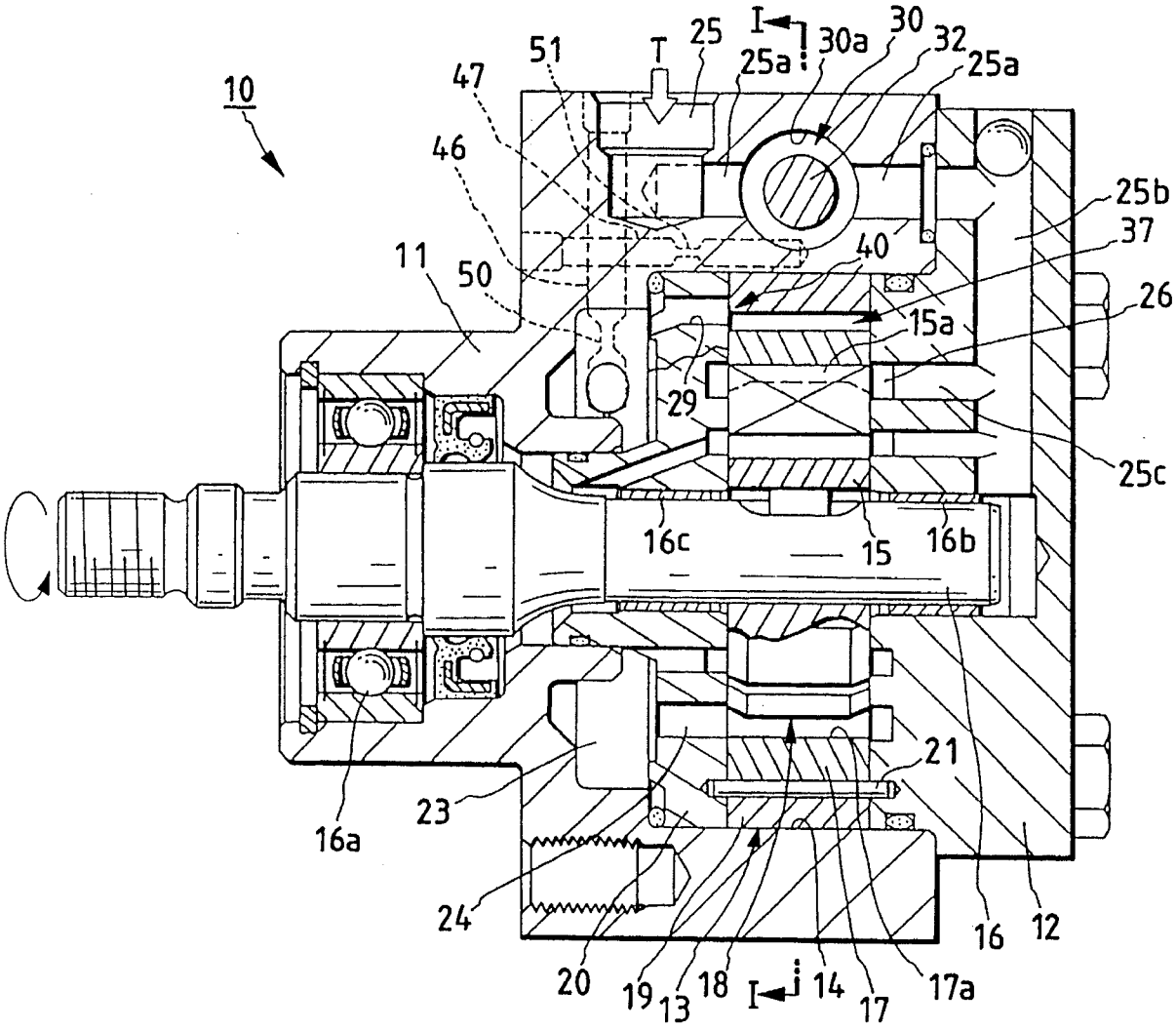
FIG. 2 is a sectional view taken on line II—II of FIG. 1.
Figure 3:
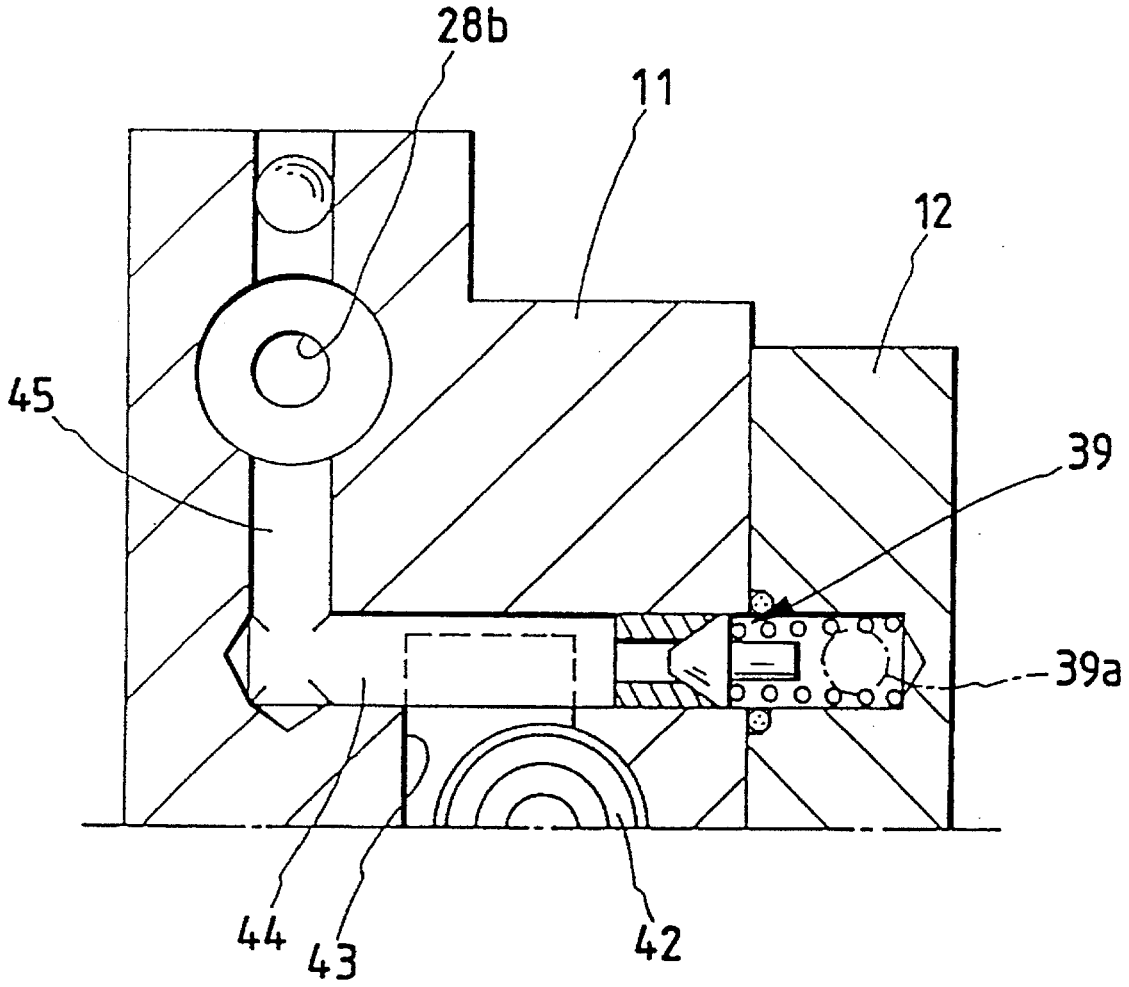
FIG. 3 is an upper-half sectional view taken on line III—III of FIG. 1.

FIGS. 1 to 3 show an embodiment of a variable displacement pump according to the present invention. In these drawings, in this embodiment, a description will be described of a case where the variable displacement pump is a vane-type oil pump as an oil-pressure generating source for a power steering apparatus in this embodiment.

As is obvious from FIGS. 1 and 2, a vane-type variable displacement pump generally designated by reference numeral 10 has a front body 11 and a rear body 12 which constitute a pump body. As is apparent from FIG. 2, this front body 11 as a whole is substantially cup-shaped, and an accommodating space 14 for accommodating pump component elements 13 such as a pump cartridge is formed therein. The rear body 12 is combined with the front body 11 in such a manner as to close an open end of the accommodating space 14, the front and rear bodies being integral with each other. In such a state that a drive shaft 16 for driving a rotor 15 of the pump component elements 13 to rotate from outside is fitted into the front body 11, the drive shaft 16 is rotatably supported by bearings 16*a*, 16*b* and 16*c* (the bearing 16*b* is installed on the side of the rear body 12, whereas the bearing 16*c* is installed on the side of a pressure plate 20, which will be described later).

Reference numeral 17 designates a cam ring having an inner cam surface 17*a* which is fitted around the outer periphery of the rotor 15 having vanes 15*a*. The cam ring 17 forms a pump chamber 18 between the inner cam surface 17*a* and the rotor 15. As will be described later, the cam ring 17 is movably and displaceably disposed in an adapter ring 19 in such a state that it is fitted onto an inner wall portion within the accommodating space 14 so that it can make variable the volume of the pump chamber 18.

Incidentally, the adapter ring 19 is used for holding the cam ring 17 movably and displaceably within the accommodating space 14 in the body 11.

Reference numeral 20 designates the pressure plate which is superposed on and forced to contact the side of the front body 11 of the pump cartridge (of the pump component elements 13) formed with the rotor 15, the cam ring 17 and the adapter ring 19. Meanwhile, the end face of the rear body 12 is brought into pressure contact with the opposite side of the pump cartridge as a side plate. In this state, the front and rear bodies 11, 12 are assembled into an integral unit and are set in a required assembled state. With these members, the pump component elements 13 are formed.

In this case, the pressure plate 20 and the rear body 12, which also serves as the side plate superposed thereon via the cam ring 17, are integrally and securely assembled together in such a state that they are positioned in the rotational direction by means of a seal pin 21, which will be described later, which also functions as a pivotally supporting portion for the swinging displacement of the cam ring 17 and a positioning pin, and by an appropriate rotation-stopper means (not shown).

Reference numeral 23 designates a pump discharge-side pressure chamber which is formed on the base side of the front body 11 in the accommodating space 14 and which allows the pump discharge-side pressure to act on the pressure plate 20. Reference numeral 24 designates a pump discharge-side opening bored in the pressure plate 20 for introducing pressure oil from the pump chamber 18 into the pump discharge-side pressure chamber 23.

Reference numeral 25 designates a pump suction port provided in part of the front body 11 as shown in FIG. 2. Suction-side fluid flowing from the port 25 is made to pass through a pump suction-side passage 25*a* bored through a control valve 30, which will be described later, and formed in the front body 11, and to pass through passages 25*b*, 25*c* continuously formed in the rear body 12 before being supplied into the pump chamber 18 from a pump suction-side opening 26 opened in the end face of the rear body 12.

In this embodiment of the invention, the suction-side passage 25*a* extending across the control valve 30, that is, passing through its valve hole 30*a* is used to introduce the suction-side fluid from the suction port 25 into the pump chamber 18. This is because the flow rate of the fluid in the pump for use in controlling the steering force according to this embodiment of the invention is as low as 7 l/min; consequently, it practically raises no problem to pass the suction-side fluid sucked from a tank T into the suction port 25 through the control valve 30.

With the arrangement above, the pump 10 in the axial direction can be made shorter than what has conventionally been provided between the control valve 30 of the front body 11 and the suction-side passage 25*b* of the rear body 12, so that the pump 10 is reducible in size. This is also because the position in which the pump 10 is fitted to the tank T may be located on the side of the front body 11, and this makes a stable fitting condition achievable.

Reference numeral 28 designates a discharge port for supplying the pump discharge-side fluid pressure from the pump chamber 18 to hydraulic equipment such as the power steering apparatus (indicated by PS in the drawing) via the pump discharge-side passage 24, the pump discharge-side pressure chamber 23, further, a fluid passage hole 29 bored in a different position of the pressure plate 20, a second fluid pressure chamber 37 as will be described later, a spring chamber 42*a*, with a plug 42, for accommodating a spring 41 for urging the cam ring 17, a notched groove 43 formed in the front body 11, and passage holes 44, 45, 28*b* formed in the body 11. The discharge port 28 is provided so that it is opened by a plug 28*a* installed on the side of the front body 11.

In this case, a variable metering orifice 40 capable of increasing or decreasing an opening area is formed with the fluid passage hole 29 opened to the second fluid pressure chamber 37 and the side portion of the cam ring 17 in the aforesaid pump discharge-side passages (24, 23, 29, 42*a*, 43, 44, 45, 28*b*). The opening and closing of the passage hole 29 in the side wall portion as the cam ring 17 is swung and displaced constitute the variable metering orifice 40. If the orifice 40 is suitably profiled so that its open-close quantity is controlled in accordance with the intensity of the fluid pressure on the discharge side of the pump, the flow-rate characteristics may be diversified.

Reference numeral 30 designates the control valve which is disposed above the accommodating space 14 in the front body 11 substantially perpendicularly thereto, and is adapted for controlling the fluid pressure for moving and displacing the aforementioned cam ring 17 in the pump body 11 (adapter ring 19) relative to the rotor 15 by means of the variable metering orifice 40 which will be described later. This control valve 30 has a spool 32 which performs a sliding operation in a valve hole 30*a* bored in the body 11 by means of the pressure difference between the upstream and downstream sides of the variable metering orifice 29 installed in the pump discharge-side passages (24, 23, 29, 42*a*, 43, 44, 45, 28*b*) and the urging force of a spring 31.

In such a control valve 30, the fluid pressure on the upstream side of the variable metering orifice 40 is introduced into one chamber (a chamber on the left-hand side of FIG. 1) 32*a* of the spool 32 via fluid passages 46, 47 extended from the pump discharge-side pressure chamber 23. Incidentally, reference number 33 in the drawing designates a closing plug for closing the valve hole 30*a* and having a rod 33*a* for stopping the leftward moving position of the spool 32 inside the valve hole 30*a* at a position where the open end of the fluid passage 47 is not closed.

In additions the spring 31 is installed in the other chamber (a chamber on the right-hand side of FIG. 1) 32*b* of the spool 32, and the fluid pressure on the downstream side of the variable metering orifice 40 is introduced into the other chamber 32*b* via the passage midway from the discharge port 28, that is, introduced from the second fluid pressure chamber 37 via a fluid passage 19*a* formed between the body 11 and the adapter ring 19, and a fluid passage 34 bored in the body 11.

Further, the pump suction-side passage 25*a* continuously formed with the suction port 5 as described above is so formed as to pass through the substantially central part of the valve hole 30*a*, and the suction-side fluid is supplied after being passed through an annular space originating from the annular groove 32*c* of the spool 32.

Figure 4:
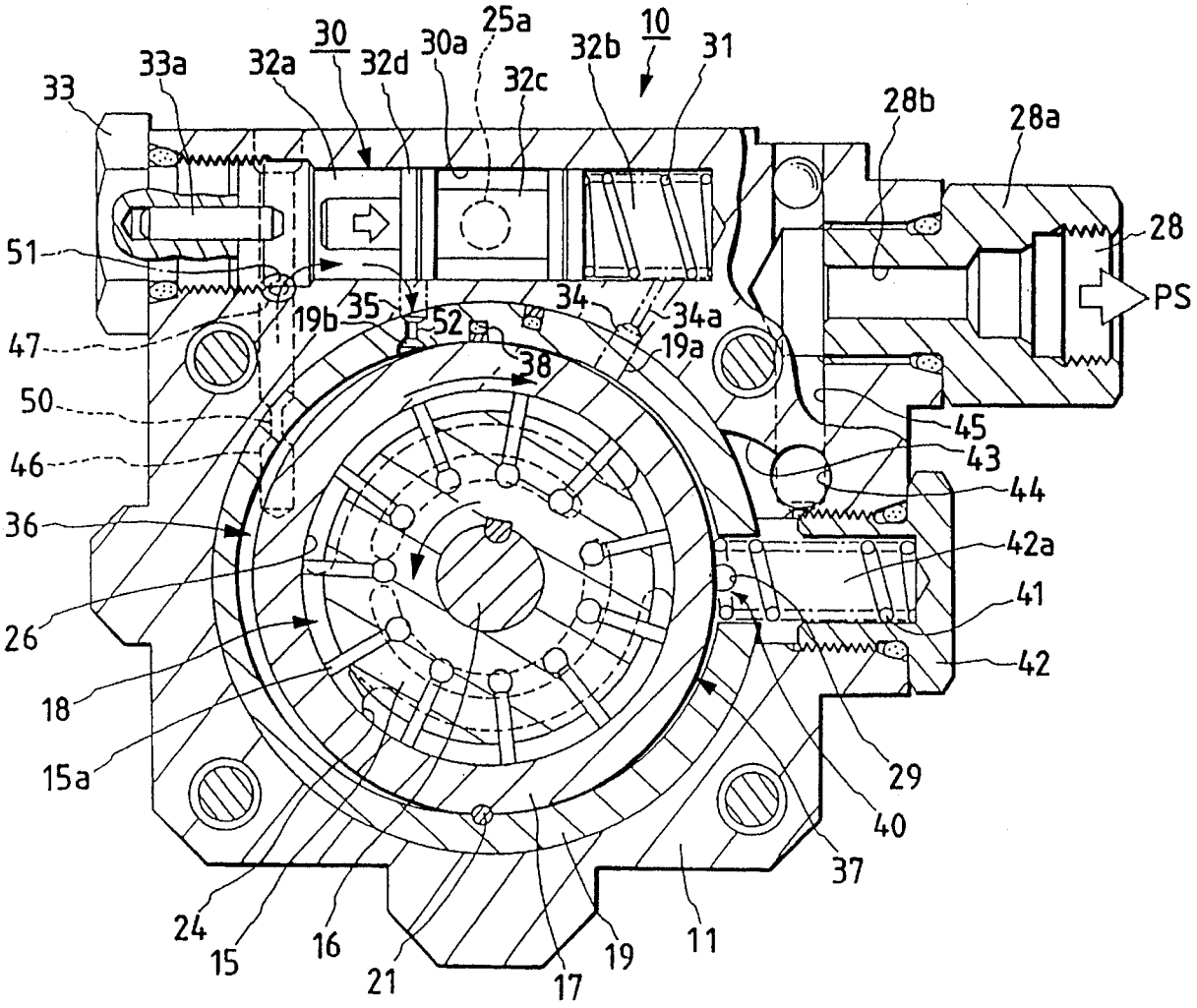
FIG. 4 is a schematic diagram illustrating the condition of the variable displacement pump of FIG. 1 in operation.

Further, the fluid passage 19*b* of the adapter ring 19 connected to a first fluid-pressure chamber 36, which will be described-later, formed between the adapter ring 19 and the cam ring 17, and a fluid passage 35 bored in the body 11 are opened-between the opening of the suction-side passage 25*a* and the opening of the above discharge-side fluid passage 47 and besides both passages normally communicate with the pump suction-side passage 25*a* by means of a land portion 32*d* as shown in FIG. 1 so as to introduce the suction-side fluid pressure into the first fluid-pressure chamber 36. When the spool 32 moves to the right to an extent exceeding a predetermined quantity, it is separated from the pump suction side as is apparent from FIG. 4, and the fluid pressure on the discharge side of the pump is supplied to the first fluid-pressure chamber 36.

Incidentally, reference numeral 34*a* designates a dumper orifice portion.

The first and second fluid-pressure chambers 36, 37 are such that they represent left- and right-hand ones partitioned by the seal pin 21 and a seal member 38 which is set substantially axially symmetrical to the seal pin on the outer periphery of the above cam ring 17 with respect to the inner peripheral portion of the body 11 (adapter ring 19). As the above control valve 30 operates, the pump suction side fluid pressure, or the pump discharge-side fluid pressure on the upstream side of the variable metering orifice 40 is introduced into the first fluid-pressure chamber 36, whereas the pump discharge-side fluid pressure on the downstream side of the variable metering orifice 40 is introduced into the second fluid-pressure chamber 37.

In this case, a substantially semi-circumferential recessed groove or the like may be formed in the outer peripheral portion of the cam ring 17 so as to secure the first fluid-pressure chamber 36 even when the cam ring 17 comes into contact with the adapter ring 19.

In FIG. 3, reference numeral 39 designates a relief valve partially facing the pump discharge-side passage and according to this embodiment of the invention, part of the fluid passage 44 bored in the body 11 is utilizing for providing such a relief valve. Further, a passage hole 39*a* continuously formed with the relief valve 39 is a passage for making the fluid thus relieved circulate through the suction side of the pump.

The variable metering orifice 40 of the present embodiment functions such that the opening area depending on the quantity of close of the fluid passage hole 29 with the cam ring 17 provides a predetermined flow rate at an initial status at the low revolution number, decreases the flow rate when the number of revolutions exceeds a constant level and further makes obtainable about half of the initial flow rate at a predetermined number of revolutions or greater. Since the discharge quantity control like this is achievable by the variable metering orifice 40 with the fluid passage hole 29 and the side portion of the cam ring 17 for controlling the opening quantity, the characteristics can be varied by, for example, altering the contour of the hole 29 as desired or adjusting the on/off control quantity by means of the cam ring 17.

In the aforementioned vane-type variable displacement pump 10, any arrangement other than those described above is heretofore well-known and the detailed description thereof will be omitted.

The variable displacement pump 10 thus arranged according to the present invention is characterized in that a first, a second-and a third throttle 50, 51, 52 are installed in the fluid passages 46, 47 between the pump discharge-side pressure chamber 23 and the control valve 30 and in the fluid passages 35, 19*b* between the control valve 30 and the first fluid-pressure chamber 36, which passages are utilized to introduce the fluid pressure in the pump discharge-side pressure chamber 23 into the control valve 30 and further into the first fluid pressure chamber 36 via the valve 30 to make the cam ring 17 move and displace.

More specifically, though the damper orifice 34*a* for stabilizing the movement of the spool 32 has been provided in the fluid passages 19*a*, 34 for introducing the fluid pressure on the downstream side of the variable metering orifice 40 into the other chamber 32*b* of the control valve 30 in the conventional variable displacement pump 10, very small throttling effect is achieved since the quantity of the passing fluid is small in this kind of pump 10 and it is therefore impossible to restrain the spool 32 from swinging or oscillating, whereby the fluid pressure in the first and second fluid-pressure chambers tends to become unstable, thus causing the swinging or oscillation of the cam ring 17 as well.

In order to suppress the swinging or oscillating phenomena of the control valve 30 (spool 32) and the cam ring 17, the throttles 50, 51, 52 are provided in the pump discharge-side fluid passages 46, 47, 35 (19*b*), so that when the discharge-side fluid pressure is introduced into the left-hand chamber 32*a* and/or the first fluid-pressure chamber 36 to operate the spool 32 of the control valve 30 and the cam ring 17, the fluid pressure is smoothly introduced while the predetermined flow rate is secured, to thereby perform the damping effect consequently.

Of the throttles 50, 51, 52 in three places in the above case, at least one or two of them or otherwise all three of them may be installed according to the present invention.

For example, the provision of the first and second throttles 50, 51 simultaneously restrain the spool 32 of the control valve 30 and the cam ring 17 from swinging and though either one can achieve the intended throttling effect, the provision of both makes it possible to increase the effect further. As is obvious from its position thus arranged, moreover, the third throttle 52 is intended to restrain only the cam ring 17 from swinging.

In other words, it is anticipated that the provision of the first, second and third throttles 50, 51, 52 in the three places maximizes the throttling effect.

Particularly by installing the throttles in the passages that have heretofore been considered indispensable such as the fluid passages 46, 47, 45 (19*b*) extending from the pump discharge-side pressure chamber 23 up to the control valve 30 and the first fluid-pressure chamber 36 according to the present invention, the fluid pressure introduced through these passages becomes hardly affected by excessive fluid pressure fluctuations externally caused, which results in restraining the valve spool 32 and the cam ring 17 from swinging. Therefore, this arrangement is greatly advantageous.

In other words, the stable supply of the fluid pressure to both chambers 32*a*, 32*b* of the control valve 30 and to the first fluid-pressure chamber 36 on the outer periphery of the cam ring 17 is secured and besides the damping effect of preventing the flow of the fluid pressure from fluctuating is brought into full play, whereby the swinging of the valve spool 32 and the cam ring 17 is suppressed.

The suppression of swinging of the valve spool 32 and the cam ring 17 in the variable displacement pump 10 with the provision of the first, second and third throttles 50, 51, 52 results in reducing the pulsation of the pump suction-side fluid pressure, thus making it possible to suppress vehicular noise, the generation of minute swinging of the steering wheel, and swinging at the time the relief valve 3 is operated and so forth.

Figure 5A:
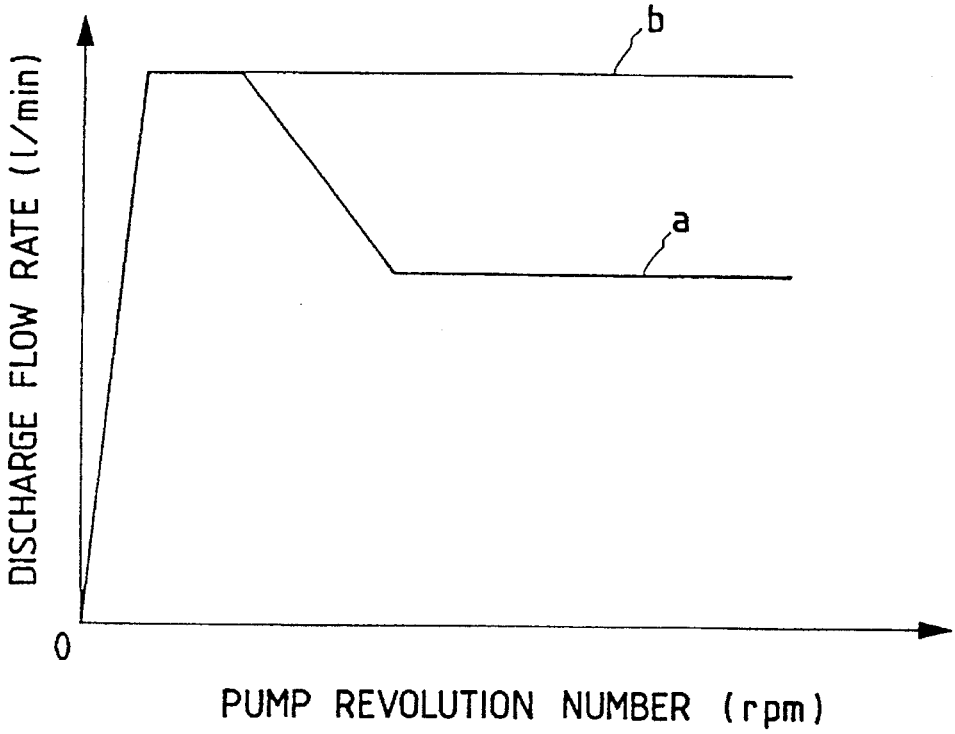
FIG. 5(*a*) is a characteristic diagram showing the relationship between the number of revolutions of the pump and a discharge flow rate in the variable displacement pump according to the present invention.
Figure 5A:
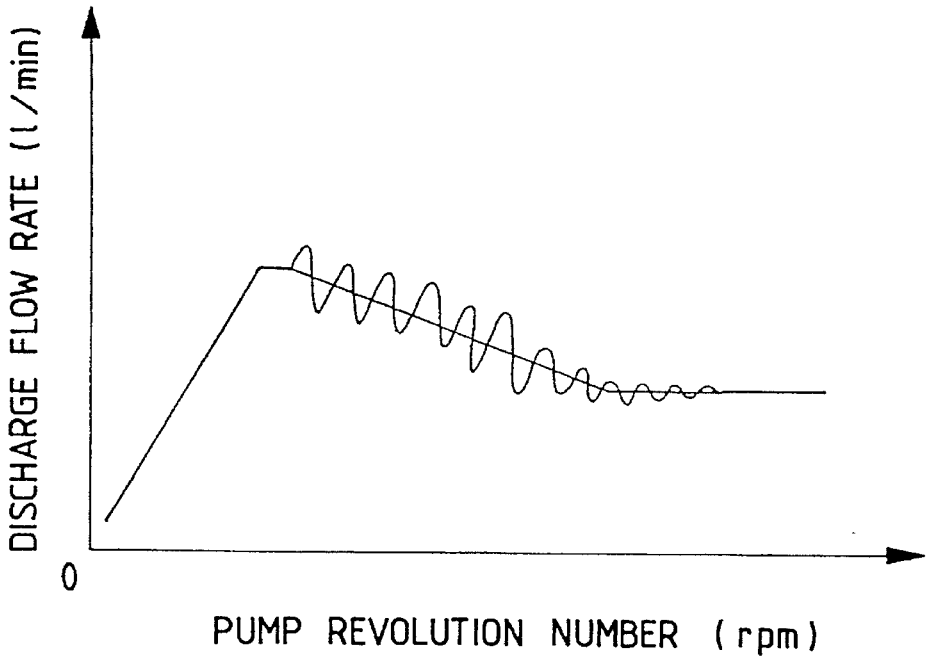
Figure 6:
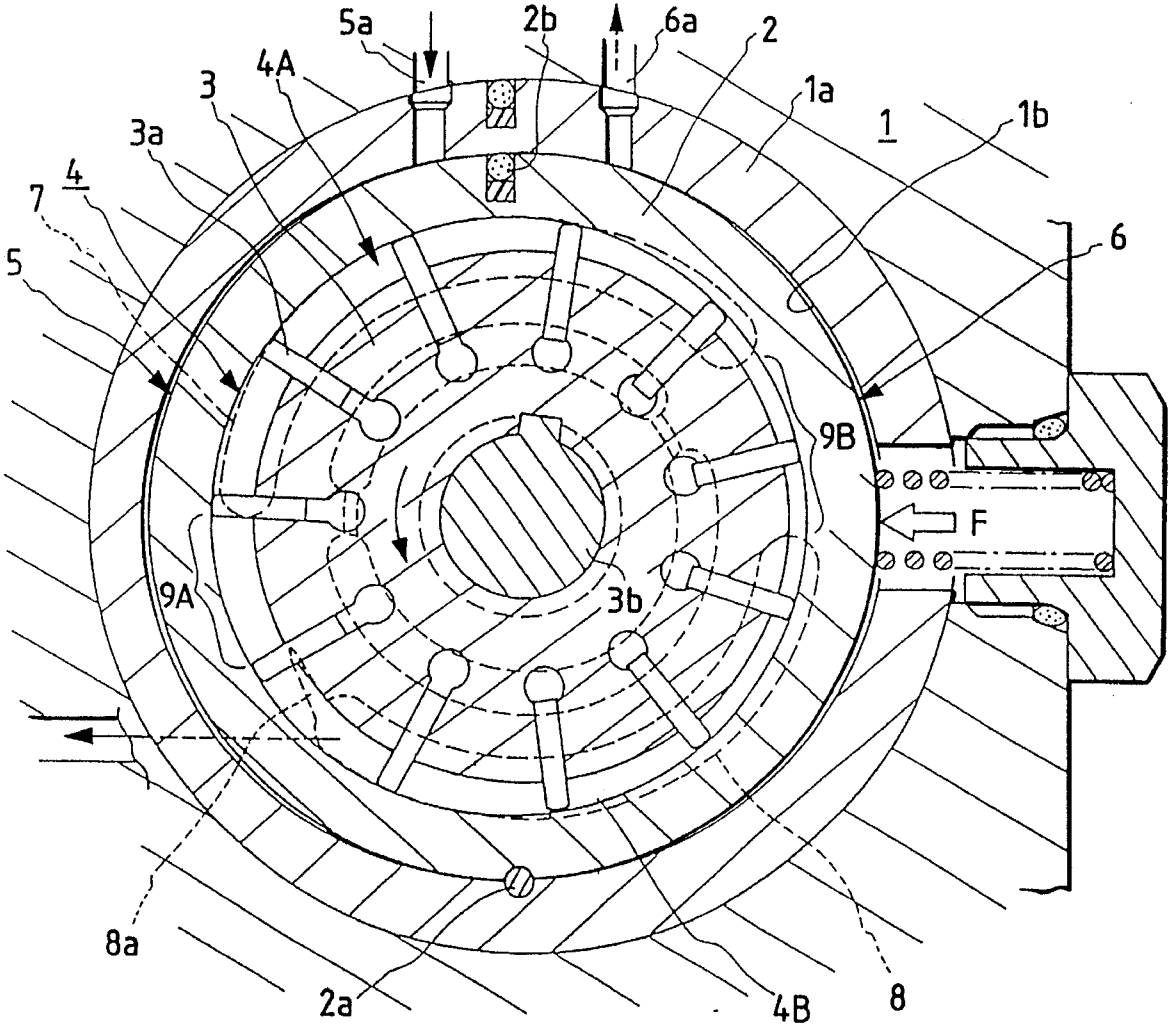
FIG. 6 PRIOR ART
FIG. 6 is a schematic diagram illustrating the structure of the principal part of a conventional variable displacement pump.

With the arrangement like this, discharge flow rate characteristics free from nonconformity such as pulsation with respect to the number of revolutions of the pump are obtainable as shown in FIG. 5(*a*). FIG. 5(*a*) refers to a case where the discharge flow rate is set lower than the peak value when the number of revolutions of the pump has increased so that steering control at high-speed traveling can be exerted in a desired condition. Any control like this is simply established by controlling the opening quantity in the variable metering orifice 40. It is needless to say free to exert control as shown in FIG. 5(*b*).

With reference to the aforementioned throttles 50, 51, 52, the following was confirmed from experiments: the fluctuation of the pump discharge-side flow rate in a case where only the third throttle 52 is installed decreases to about 1/15 in comparison with a case where it is not installed; the fluctuation thereof in a case where only the first and second throttles 50, 52 are installed decreases to about 1/20 comparing with a case where they are not; further, the fluctuation thereof in a case where the first, second and third throttles 50, 51, 52 are installed decreases to about 1/22 comparing with a case where they are not.

In the pump 10 thus arranged according to the above embodiment of the invention, the relief valve 39 for preventing the pump discharge-side fluid pressure from excessively rising is separately installed in the bodies 1, 12 in such a manner as to face the pump discharge-side fluid passage 44 apart from the control valve 30. However, the present invention is not limited to the above arrangement but may include what has a built-in relief valve, that is, the relive valve incorporated in the spool 32 of the control valve 30. The use of such a built-in relief valve is advantageous in that the whole pump body including the valve 30 can be made compact.

The present invention is not limited to the arrangements according to the aforesaid embodiment of the invention but may freely be modified in various manners in which, for example, the shape and structure of each component element are appropriately changed and converted.

Although the first and second throttles 50, 51 are installed in the fluid passages 46, 47 extending from the pump discharge-side pressure chamber 23 up to the one chamber 32*a* of the control valve 30 according to the above embodiment of the invention, for example, the invention is not limited to this arrangement but may include what has more than two throttles in the above fluid passages 46, 47 and more than one throttle in the fluid passages 35, 19*b* extending from the control valve 30 up to the first fluid-pressure chamber 36; namely, a multistage throttle in more than three places in total.

Although there is shown a case where the annular space for use in holding the cam ring 17 movably and displaceably is formed with respect to the adapter ring 19 according to the above embodiment of the invention, the invention is not limited to this arrangement but may include what has the cam ring 17 held movably and displaceably in the pump body 11.

Further, the vane-type variable displacement pump 10 in the above arrangement is needless to say not limited in structure to what has been proposed in the above embodiment of the invention but may be applied to various kinds of equipment and apparatus other than the power steering apparatus described therein.

As set forth above, the variable displacement pump according to the present invention comprises: the cam ring fitted to the outer periphery of the rotor which is rotatable within the pump body so as to form the pump chamber, the cam ring being installed so that it is movable and displaceable within the body; the first and second fluid-pressure chambers formed between the outer periphery of the cam ring and the body so as to move and displace the cam ring by selectively introducing the fluid pressure between the front and rear of the metering orifice installed midway from the pump chamber up to the discharge-side passage or the fluid pressure on the suction side of the pump; and the spool-type control valve for controlling the fluid pressure supplied to each fluid-pressure chamber in proportion to the flow rate of the pressure fluid discharged from the pump chamber, the control valve being operated by the fluid pressure between the front and rear of the metering orifice, wherein the upstream side of the metering orifice in the discharge-side passage from the pump chamber is coupled via the fluid passage to one chamber of the control valve; the downstream side of the metering orifice is coupled via the fluid passage to the other chamber of the control valve; the suction side of the pump is coupled to the axially-directed central part of the control valve; the fluid passage is provided so as to selectively couple the discharge and suction sides of the pump coupled to the one chamber of the control valve to the first fluid-pressure chamber in response to the movement of the spool; and the throttle portion having a single stage or a multistage throttle is provided in at least either fluid passage extending from the discharge side of the pump up to the one chamber of the control valve or what extends from the control valve up to the first fluid-pressure chamber. The variable displacement pump has the following effect, though it is simple in construction.

Since the single or multistage throttle is provided in the fluid passage extending from the pump discharge-side pressure chamber up to the control valve according to the present invention, the pressure fluctuations are restrained by the throttle function, which results in suppressing or preventing not only the swinging of the spool of the valve that has posed a problem but also that of the cam ring and besides reducing the flow-rate fluctuations and pulsation produced on the discharge side of the pump. A silent variable displacement pump is thus obtainable.

Such a variable displacement pump is advantageous in that a reduction in hydraulic pressure pulsation can suppress any nonconformity arising from vehicular noise, minute vibration of a steering wheel and so forth.

Particularly according to the present invention, the metering orifice for operating the control valve for controlling the fluid pressure supplied to the first and second fluid-pressure chambers on the outer peripheral-side of the cam ring according to the present invention is formed as a variable metering orifice with the hole portion bored in the side wall portion arranged on the side portion of the cam ring, and the side portion of the cam ring for controlling the opening and closing of the open end of the hole portion, whereby the movement and displacement of the cam ring are controllable as desired in proportion to the flow rate of the fluid on the discharge side of the pump.

Since the throttle portion is capable of suppressing the movement and swinging of the control valve even with the provision of the built-in relief valve in the spool of the control valve according to the present invention, moreover, it is unnecessary to take the assembling of the relief valve into consideration and this is advantageous as the pump as a whole can be made compact.

What is claimed is:

1. A variable displacement pump comprising:

a rotor having vanes and rotatably arranged within a pump body;

a cam ring fitted on an outer periphery of the rotor and movably arranged within the pump body for forming a variable pump chamber, the cam ring being urged in a direction to increase the pump chamber in volume;

a discharge-side passage through which fluid discharged from the pump chamber flows;

a metering orifice provided at a midway in the discharge-side passage;

first and second fluid-pressure chambers formed between an outer periphery of the cam ring and the pump body and sealingly divided from each other with sealing means;

a control valve having a spool, said control valve being controlled by pressure difference between upstream and downstream sides of the metering orifice for selectively introducing fluid pressure on a suction side of the pump and the upstream and downstream sides of the metering orifice into the first and second fluid-pressure chambers to operatively move the cam ring in accordance with flow rate of the pressure fluid discharged from the pump chamber;

a first fluid passage for communicating the upstream side of the metering orifice in the discharge-side passage with a first valve chamber of the control valve;

a second fluid passage for communicating the downstream side of the metering orifice with a second valve chamber of the control valve;

a third valve chamber of the control valve, located axially between the first and second valve chambers and communicated with the suction side of the pump;

a third fluid passage for selectively communicating one of the first and third valve chambers with the first fluid-pressure chamber in response to the movement of the spool; and at least one throttle portion provided in at least one of the first and third fluid passages.

2. A variable displacement pump as claimed in claim 1, wherein the throttle portion is provided in the first fluid passage.

3. A variable displacement pump as claimed in claim 1, wherein the throttle portion is provided in the third fluid passage.

4. A variable displacement pump as claimed in claim 1 wherein three throttle portions are provided, one being in the third fluid passage and the remaining two being in the first fluid passage.

5. A variable displacement pump as claimed in claim 1, wherein an opening ratio of the metering orifice is variable in such a manner that a side face of the cam ring operatively opens and closes a hole portion of the metering orifice in association with the movement of the cam ring.

6. A variable displacement pump as claimed in claim 1, wherein the metering orifice is located at least partially in the second fluid-pressure chamber.

7. A variable displacement pump as claimed in claim 1, wherein said second fluid-pressure chamber forms a portion of the discharge-side passage.

8. A variable displacement pump as claimed in claim 1, wherein the suction side of the pump is communicated with the pump chamber through the third valve chamber.

9. A variable displacement pump as claimed in claim 1, wherein said cam ring is pivotable with respect to the pump body.

10. A variable displacement pump as claimed in claim 1, wherein at least one throttle portion is provided in the second fluid passage.

* * * * *